United States Patent [19]

Backman

[11] Patent Number: 4,569,513

[45] Date of Patent: Feb. 11, 1986

[54] NEWSPAPER STACKING PLANT

[75] Inventor: Ralf Backman, Eksjö , Sweden

[73] Assignee: Wamac-Idab AB, Eksjö , Sweden

[21] Appl. No.: 363,435

[22] Filed: Mar. 30, 1982

[30] Foreign Application Priority Data

Apr. 6, 1981 [SE] Sweden ..... 8102197
Jan. 22, 1982 [SE] Sweden ..... 8200358

[51] Int. Cl.[4] ..... B65H 29/34

[52] U.S. Cl. ..... 271/189; 271/151; 271/258; 271/280; 271/305

[58] Field of Search ..... 271/189, 237, 151, 279, 271/280, 258, 259, 303, 305

[56] References Cited

U.S. PATENT DOCUMENTS 3,623,722 11/1971 Sjogren ..... 271/303
4,004,694 1/1977 Sjogren ..... 271/303
4,151,986 5/1979 Kawada ..... 271/303
4,235,434 11/1980 Müller ..... 271/280
4,302,198 11/1981 Kawada ..... 271/303
4,447,052 5/1984 Muller ..... 271/303

*Primary Examiner*—Douglas C. Butler
*Assistant Examiner*—John A. Carroll
*Attorney, Agent, or Firm*—Young & Thompson

[57] ABSTRACT

In a newspaper stacking plant a sensor is placed at a point along the newspaper path. After counting a predetermined number of newspapers, the sensor control electronics actuate a first intercepter means to provide a gap in the newspaper flow. The subsequent newspapers are led to a first collection station such as a stacking blade. The sensor control electronics also control a second intercepter such as a deflecting tongue entering the newspaper flow on actuation, at a point between the first intercepter and the first collection station, a predetermined number of newspapers being diverted and led to a second collection station. The inventive device enables machine diversion of small portions from the newspaper flow to the second collection station, while the major portion is led to the first collection station.

1 Claim, 2 Drawing Figures

NEWSPAPER STACKING PLANT

The present invention relates to a plant for stacking newspaper and is of the kind including an input path for a flow of newspapers overlapping each other, a newspaper counter or sensor at a place along the path and connected to control electronics which are settable to count a selectable number of newspapers and connected to an intercepter means to activate the latter and provide a gap in the flow of newspapers so that the selected number of newspapers can be directed further and delivered to a collection point such as a stacking blade.

In plants known up to now of the kind in question, the least stack of newspapers which can be formed is entirely dependent on the cycle time of the stacking means. In practice, this cannot fall below 1.0 sec. with such means known to the art. In its turn, this means that the smallest stack which can be formed at a press speed of 60,000 copies per hour is one of 17 copies. Stacks with a lesser number of copies must be made by hand. The number of such manually laid stacks is relatively large in most newspaper printing rooms, and the manual working time therefore results in corresponding increased labour costs and reduced production capacity.

The object of the present invention is therefore to provide a stacking plant with means enabling machine stacking of small stacks having a small number of copies right down to one or several copies, independent of the prevailing printing speed.

This is achieved with a plant of the kind in question which, in accordance with the invention, has the characterizing features disclosed below.

The problem under review has thus been given a simple solution by the invention, which will also be apparent from the following description of an embodiment, schematically illustrated on the appended drawings, or a newspaper stacking plant or stacker in accordance with the invention.

Figure 1:
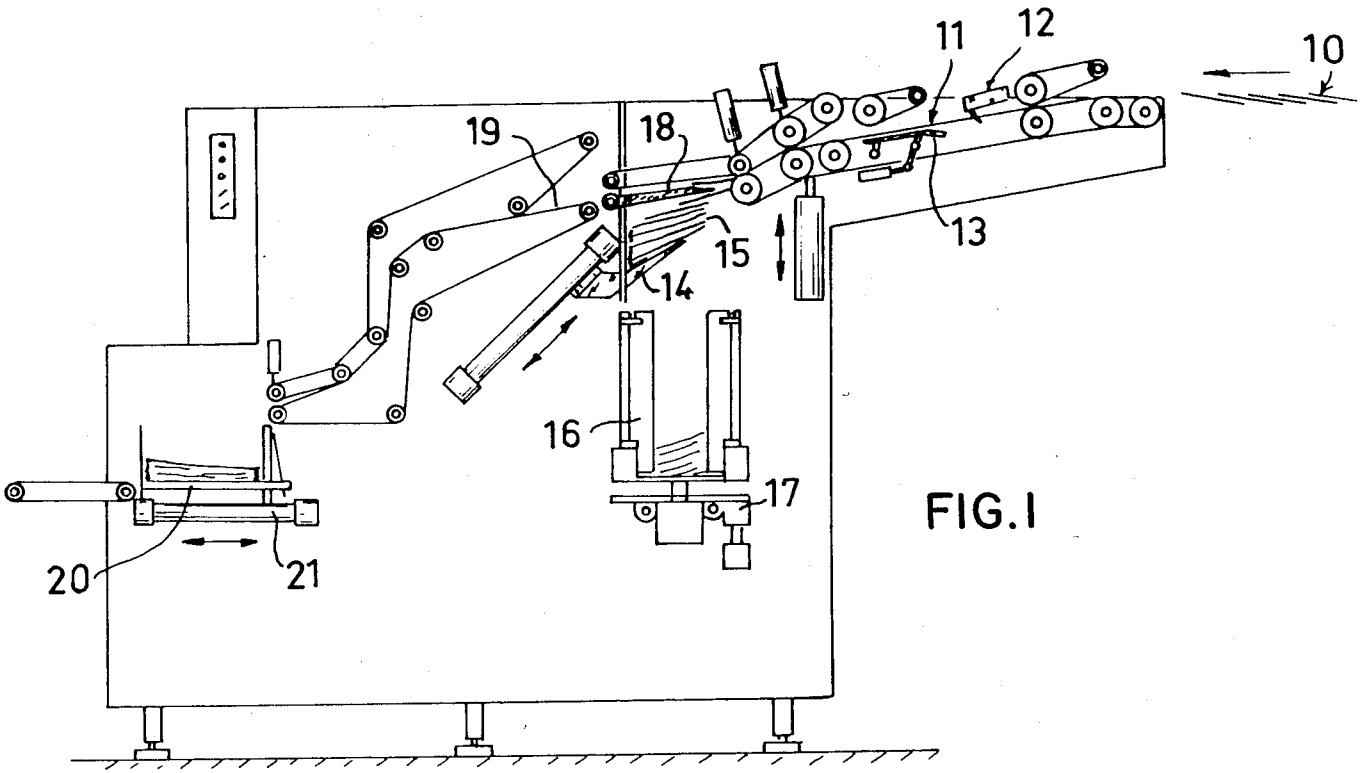
Figure 2:
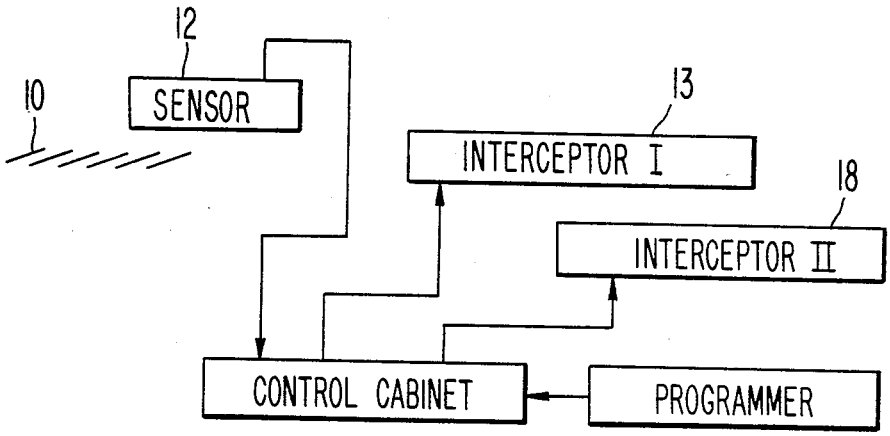

FIG. 1 is a diagrammatic overall view of a newspaper stacking plant in accordance with the present invention; and FIG. 2 is a simplified schematic circuit showing the control electronics therefor.

A flow 10 of newspapers overlapping each other are fed into the plant in a manner known per se.

The newspapers on the input path 11 are counted by a conventional newspaper counter or sensor 12. When a predetermined number of newspapers, e.g. 25 copies, have passed the sensor, it provides an impulse which activates an interceptor means 13, this means then providing a gap in the flow of newspapers. The predetermined number of newspapers after the gap are led away and are collected into a stack 15 or a so-called pack at a collection station in the form of a stacking blade 14, and when the stack 15 is ready, the stacking blade is actuated, whereafter the pack falls down into a reversing basket 16 in a manner known per se. After each pack has been dropped into the basket, the latter is actuated to rotate 180°.

When two packs for example, i.e. 50 copies in this case, have been stacked to a ready stack in the basket, a pusher 17 is actuated to swing the basket in a manner known per se, so that the ready stack is thrust out to the right or to the left in the figure for discharging from the plant.

In accordance with the invention, a second intercepter means 18, e.g. in the form of a deflecting tongue, may be coupled into the flow of newspapers at a place situated along the newspaper path between the first intercepter means 13 and the collection station or stacking blade 14.

The intercepter means 18 is controlled by the sensor 12 and when actuated it is adapted to interrupt the flow of newspapers to deflect a predetermined number of newspapers, which lie between said gap in the newspaper flow and the means 18, to an outlet path 19 leading the predetermined number of newspapers to a second collection station comprising a stacking table 20, in the illustrated example. When the desired stack has been formed on the table, it is thrust out with the aid of a pusher 21.

The apparatus in accordance with the invention functions in the following manner.

Let it be assumed that it is desired to form a stack of 25 copies in the usual way in the basket 16, and that it is further desired to lay off a stack of 8 copies, for example, on the table 20. The electronics are then coupled in for this purpose such that the sensor 12 counts $25+8=33$ newspapers before the intercepter means 13 is activated to form a gap in the usual way.

These 33 copies continue their path, and when 25 copies have passed the intercepter means 18, said means receives an impulse from the control electronics connected to the sensor 12 so that it is activated for deviating the following 8 copies to the output path 19 for collection on the table 20. When the last of these 8 copies has passed the means 18 with the aid of the deflecting tongue, the tongue is caused to return to its original position, so that subsequent newspapers will go to the stacking blade 14 to form a new large stack. This new large stack of 25 copies of newspaper can naturally also be combined with one or more projecting newspapers, which may be deflected to the output path 19 and the table 20 in the simple manner described above.

In accordance with the invention, it is thus possible to deflect a number of newspapers to the path 19 and the table 20, it being possible to select this number from one copy up to the number which is the minimum size of a stack which can be formed in the large stack section, independent of the prevailing printing press speed. In accordance with the invention, it is thus possible to prepare all appropriate stack sizes completely by machine.

What I claim is:

1. In a newspaper stacking plant having means defining an input path for the flow of newspapers overlapping each other, a newspaper counter disposed along the path, control electronics for receiving signals from said counter, first interceptor means responsive to said control electronics to provide a gap in the flow of newspapers when said counter has counted a first predetermined number of newspapers, and a collection station for collecting at least some of said first predetermined number of newspapers; the improvement comprising second interceptor means responsive to said control electronics, said second interceptor means being disposed along the path of the newspapers between said first interceptor means and said collection station and being controlled by said control electronics after a second predetermined number of newspapers less than said first predetermined number of newspapers has passed said second intercepter means, to divert them from said collection station a third predetermined number of newspapers less than said first predetermined number of newspapers to an output path leading to a second collection station, the sum of said second and third predetermined numbers being equal to said first predetermined number, wherein said second interceptor means deflects all the newspapers immediately preceding said gap which are equal in number to said third predetermined number.

* * * * *